US009583113B2

(12) United States Patent
Kapinos

(10) Patent No.: US 9,583,113 B2
(45) Date of Patent: Feb. 28, 2017

(54) AUDIO COMPRESSION USING VECTOR FIELD NORMALIZATION

(71) Applicant: Lenovo (Singapore) Pte. Ltd., Singapore (SG)

(72) Inventor: Robert J. Kapinos, Durham, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 66 days.

(21) Appl. No.: 14/674,355

(22) Filed: Mar. 31, 2015

(65) Prior Publication Data

US 2016/0293169 A1 Oct. 6, 2016

(51) Int. Cl.

| | |
|---|---|
| ***H04R 5/00*** | (2006.01) |
| ***G10L 19/008*** | (2013.01) |
| ***H04S 5/00*** | (2006.01) |
| *G10L 19/00* | (2013.01) |

(52) U.S. Cl.

CPC ..... *G10L 19/008* (2013.01); *H04S 5/005* (2013.01); *G10L 2019/0005* (2013.01); *H04S 2400/07* (2013.01); *H04S 2420/13* (2013.01)

(58) Field of Classification Search

CPC ..... G10L 19/008; G10L 19/00; G10L 2021/02166; G10L 19/032; H04R 3/005; H04R 2410/05; H04R 1/04; H04R 2499/11

USPC ... 381/307, 22, 23, 92, 94.7, 94.9, 106, 122; 704/500, 501

See application file for complete search history.

(56) References Cited

U.S. PATENT DOCUMENTS

| | | | | |
|---|---|---|---|---|
| 2004/0083094 | A1* | 4/2004 | Zelazo | G10L 19/0216 704/212 |
| 2008/0097766 | A1* | 4/2008 | Kim | G10L 19/00 704/500 |
| 2011/0060595 | A1* | 3/2011 | Trainor | G10L 19/22 704/500 |
| 2011/0224992 | A1* | 9/2011 | Chaoui | G10L 19/018 704/500 |
| 2013/0034170 | A1* | 2/2013 | Chen | H04N 13/00 375/240.25 |
| 2013/0332156 | A1* | 12/2013 | Tackin | H04M 1/6041 704/226 |
| 2014/0164454 | A1* | 6/2014 | Zhirkov | H03M 7/55 707/829 |
| 2015/0264507 | A1* | 9/2015 | Francombe | H04S 7/301 381/303 |
| 2016/0066117 | A1* | 3/2016 | Chen | H04R 3/005 381/26 |

* cited by examiner

*Primary Examiner* — Alexander Jamal

(74) *Attorney, Agent, or Firm* — Van Leeuwen & Van Leeuwen; Carlos Munoz-Bustamante

(57) ABSTRACT

An approach is provided for creating a digital representation of an analog sound. The approach retrieves a number of digital sound data streams with each of the digital sound data streams corresponding to an orientation angle of the digital sound data streams with respect to one another. The digital representation of the analog sound is generated by processing the digital sound data streams and their corresponding orientation angles.

28 Claims, 8 Drawing Sheets

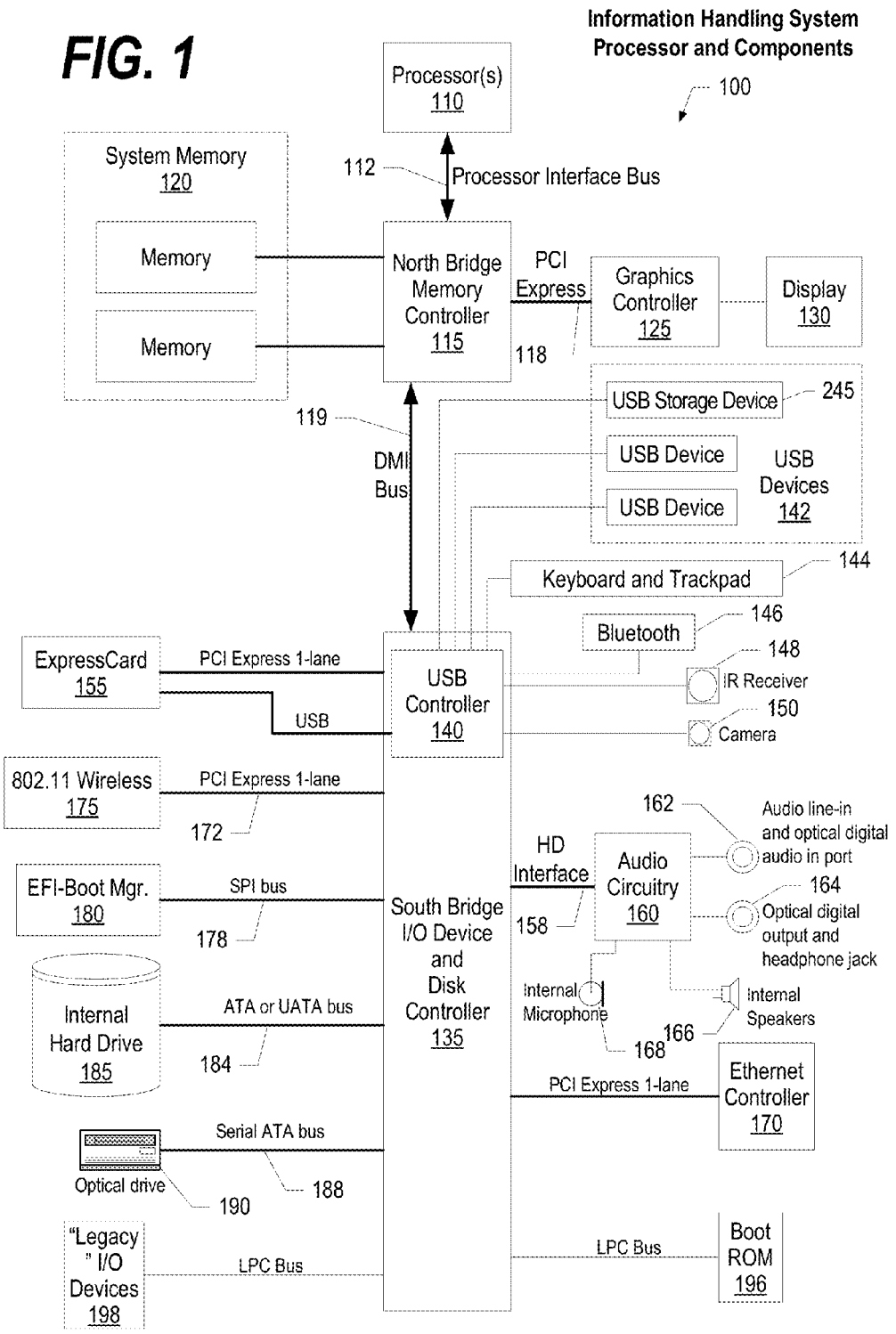
FIG. 1
Information Handling System
Processor and Components
100
Processor(s)
110
System Memory
120
112
Processor Interface Bus
Memory
Memory
North Bridge
Memory
Controller
115
PCI
Express
118
Graphics
Controller
125
Display
130
USB Storage Device
245
119
DMI
Bus
USB Device
USB Device
USB
Devices
142
Keyboard and Trackpad
144
Bluetooth
146
ExpressCard
155
PCI Express 1-lane
USB
USB
Controller
140
148
IR Receiver
150
Camera
802.11 Wireless
175
PCI Express 1-lane
172
162
Audio line-in
and optical digital
audio in port
HD
Interface
Audio
Circuitry
160
EFI-Boot Mgr.
180
SPI bus
178
South Bridge
I/O Device
and
Disk
Controller
135
158
164
Optical digital
output and
headphone jack
Internal
Hard Drive
185
ATA or UATA bus
184
Internal
Microphone
Internal
Speakers
166
168
PCI Express 1-lane
Ethernet
Controller
170
Serial ATA bus
Optical drive
188
190
"Legacy
" I/O
Devices
198
LPC Bus
LPC Bus
Boot
ROM
196

Sampling of Each Angular Interval Using Consistent Algorithm
Depending on Perceptual Mask and How Masks Combine
400

Sampling Produces Quantized Waveform Across Channels
450

AUDIO COMPRESSION USING VECTOR FIELD NORMALIZATION

BACKGROUND

Current multi-channel audio compression methods are bulky and processor intensive. Multi-channel audio compression is often used to create "surround sound" where a system produces sound that appears to surround the listener. Speakers are situated around the listener to provide the impression that sounds are coming from all possible direction. Consequently, surround sound often provides a more realistic experience, especially when listening to soundtracks of motion pictures and when engaged in video games.

Current multi-channel audio compression methods require discrete speaker arrangements to output the sound in a quality manner. One approach to current multi-channel audio compression is using "n.n" audio tracks, such as "5.1," "7.1," etc. In a 5.1 system, there are 5 channels of sound (left, right, center, left surround, and right surround) and 1 channel for low frequency effects (LFE), usually produced by a subwoofer. A 7.1 system is similar but provides an additional left rear and right reach channel for seven channels with the same single channel for LFE. Currently, to produce these effects each channel is stored separately and is bandwidth intensive to transmit. The approaches often need matching speaker outputs to produce the sound correctly. These approaches also utilize intensive remixing in which the source is recoded by same style of equipment. These approaches also result in perceptual coding that limits sound fidelity since re-composition of depends on the psychoacoustic model that was used.

SUMMARY

An approach is provided for creating a digital representation of an analog sound. The approach retrieves a number of digital sound data streams with each of the digital sound data streams corresponding to an orientation angle of the digital sound data streams with respect to one another. The digital representation of the analog sound is generated by processing the digital sound data streams and their corresponding orientation angles.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages will become apparent in the non-limiting detailed description set forth below.

BRIEF DESCRIPTION OF THE DRAWINGS

This disclosure may be better understood by referencing the accompanying drawings, wherein:

FIG. 1 is a block diagram of a data processing system in which the methods described herein can be implemented;

DETAILED DESCRIPTION

Figure 2:
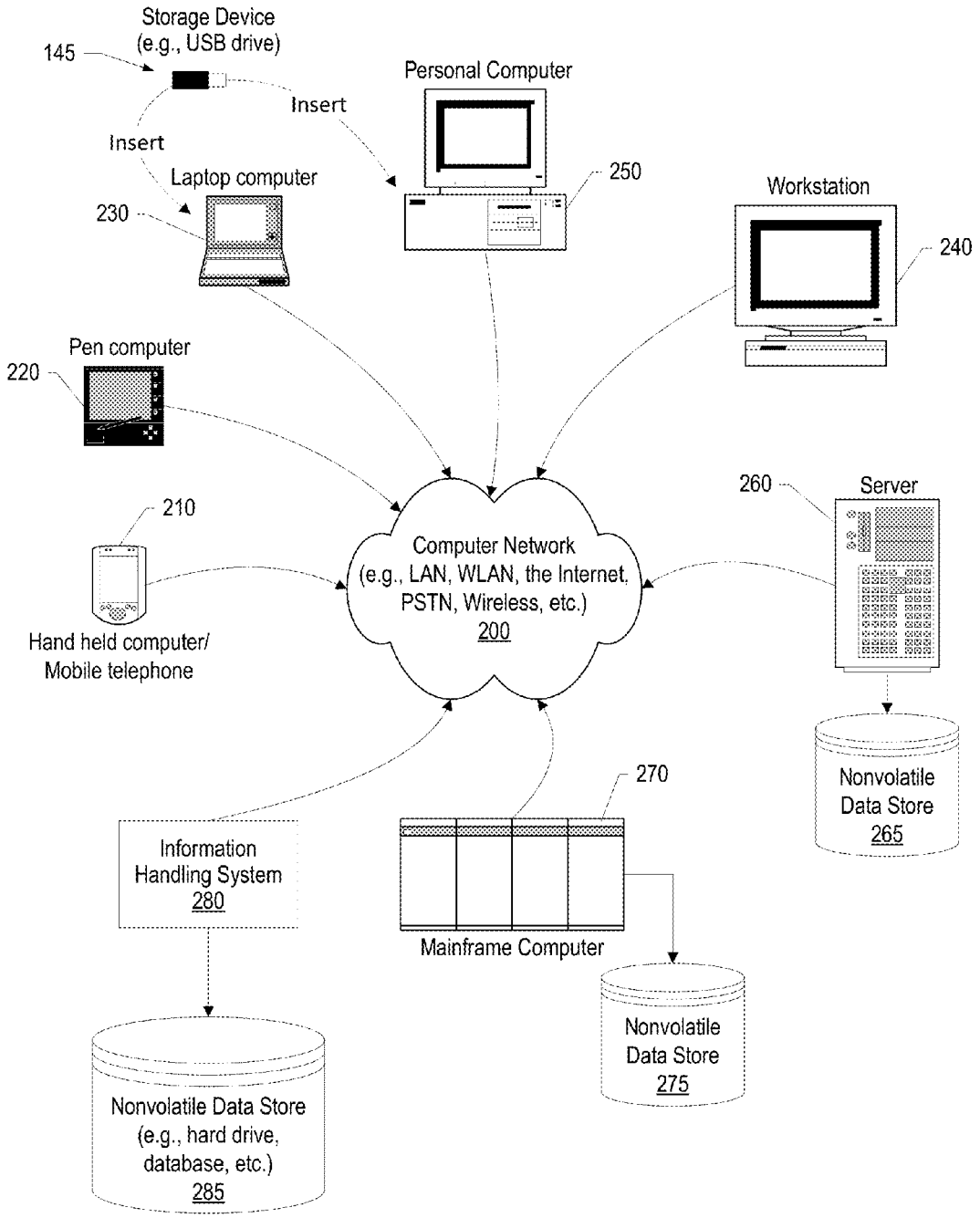
FIG. 2 provides an extension of the information handling system environment shown in FIG. 1 to illustrate that the methods described herein can be performed on a wide variety of information handling systems which operate in a networked environment.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The detailed description has been presented for purposes of illustration, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

As will be appreciated by one skilled in the art, aspects may be embodied as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable storage medium(s) may be utilized. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device. As used herein, a computer readable storage medium does not include a transitory signal.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described below with reference to flowchart illustrations and/or block diagrams of methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The following detailed description will generally follow the summary, as set forth above, further explaining and expanding the definitions of the various aspects and embodiments as necessary. To this end, this detailed description first sets forth a computing environment in FIG. 1 that is suitable to implement the software and/or hardware techniques associated with the disclosure. A networked environment is illustrated in FIG. 2 as an extension of the basic computing environment, to emphasize that modern computing techniques can be performed across multiple discrete devices.

FIG. 1 illustrates information handling system 100, which is a simplified example of a computer system capable of performing the computing operations described herein. Information handling system 100 includes one or more processors 110 coupled to processor interface bus 112. Processor interface bus 112 connects processors 110 to Northbridge 115, which is also known as the Memory Controller Hub (MCH). Northbridge 115 connects to system memory 120 and provides a means for processor(s) 110 to access the system memory. Graphics controller 125 also connects to Northbridge 115. In one embodiment, PCI Express bus 118 connects Northbridge 115 to graphics controller 125. Graphics controller 125 connects to display device 130, such as a computer monitor.

Northbridge 115 and Southbridge 135 connect to each other using bus 119. In one embodiment, the bus is a Direct Media Interface (DMI) bus that transfers data at high speeds in each direction between Northbridge 115 and Southbridge 135. In another embodiment, a Peripheral Component Interconnect (PCI) bus connects the Northbridge and the Southbridge. Southbridge 135, also known as the I/O Controller Hub (ICH) is a chip that generally implements capabilities that operate at slower speeds than the capabilities provided by the Northbridge. Southbridge 135 typically provides various busses used to connect various components. These busses include, for example, PCI and PCI Express busses, an ISA bus, a System Management Bus (SMBus or SMB), and/or a Low Pin Count (LPC) bus. The LPC bus often connects low-bandwidth devices, such as boot ROM 196 and "legacy" I/O devices (using a "super I/O" chip). The "legacy" I/O devices (198) can include, for example, serial and parallel ports, keyboard, mouse, and/or a floppy disk controller. The LPC bus also connects Southbridge 135 to Trusted Platform Module (TPM) 195. Other components often included in Southbridge 135 include a Direct Memory Access (DMA) controller, a Programmable Interrupt Controller (PIC), and a storage device controller, which connects Southbridge 135 to nonvolatile storage device 185, such as a hard disk drive, using bus 184.

ExpressCard 155 is a slot that connects hot-pluggable devices to the information handling system. ExpressCard 155 supports both PCI Express and USB connectivity as it connects to Southbridge 135 using both the Universal Serial Bus (USB) the PCI Express bus. Southbridge 135 includes USB Controller 140 that provides USB connectivity to devices that connect to the USB. These devices include webcam (camera) 150, infrared (IR) receiver 148, keyboard and trackpad 144, and Bluetooth device 146, which provides for wireless personal area networks (PANs). USB Controller 140 also provides USB connectivity to other miscellaneous USB connected devices 142, such as a mouse, removable nonvolatile storage device 145, modems, network cards, ISDN connectors, fax, printers, USB hubs, and many other types of USB connected devices. While removable nonvolatile storage device 145 is shown as a USB-connected device, removable nonvolatile storage device 145 could be connected using a different interface, such as a Firewire interface, etcetera.

Wireless Local Area Network (LAN) device 175 connects to Southbridge 135 via the PCI or PCI Express bus 172. LAN device 175 typically implements one of the IEEE 802.11 standards of over-the-air modulation techniques that all use the same protocol to wireless communicate between information handling system 100 and another computer system or device. Optical storage device 190 connects to Southbridge 135 using Serial ATA (SATA) bus 188. Serial ATA adapters and devices communicate over a high-speed serial link. The Serial ATA bus also connects Southbridge 135 to other forms of storage devices, such as hard disk drives. Audio circuitry 160, such as a sound card, connects to Southbridge 135 via bus 158. Audio circuitry 160 also provides functionality such as audio line-in and optical digital audio in port 162, optical digital output and headphone jack 164, internal speakers 166, and internal microphone 168. Ethernet controller 170 connects to Southbridge 135 using a bus, such as the PCI or PCI Express bus. Ethernet controller 170 connects information handling system 100 to a computer network, such as a Local Area Network (LAN), the Internet, and other public and private computer networks.

While FIG. 1 shows one information handling system, an information handling system may take many forms. For example, an information handling system may take the form of a desktop, server, portable, laptop, notebook, or other form factor computer or data processing system. In addition, an information handling system may take other form factors such as a personal digital assistant (PDA), a gaming device, ATM machine, a portable telephone device, a communication device or other devices that include a processor and memory.

The Trusted Platform Module (TPM 195) shown in FIG. 1 and described herein to provide security functions is but one example of a hardware security module (HSM). Therefore, the TPM described and claimed herein includes any type of HSM including, but not limited to, hardware security devices that conform to the Trusted Computing Groups (TCG) standard, and entitled "Trusted Platform Module (TPM) Specification Version 1.2." The TPM is a hardware security subsystem that may be incorporated into any number of information handling systems, such as those outlined in FIG. 2.

FIG. 2 provides an extension of the information handling system environment shown in FIG. 1 to illustrate that the methods described herein can be performed on a wide variety of information handling systems that operate in a networked environment. Types of information handling systems range from small handheld devices, such as handheld computer/mobile telephone 210 to large mainframe systems, such as mainframe computer 270. Examples of handheld computer 210 include personal digital assistants (PDAs), personal entertainment devices, such as MP3 players, portable televisions, and compact disc players. Other examples of information handling systems include pen, or tablet, computer 220, laptop, or notebook, computer 230, workstation 240, personal computer system 250, and server 260. Other types of information handling systems that are not individually shown in FIG. 2 are represented by information handling system 280. As shown, the various information handling systems can be networked together using computer network 200. Types of computer network that can be used to interconnect the various information handling systems include Local Area Networks (LANs), Wireless Local Area Networks (WLANs), the Internet, the Public Switched Telephone Network (PSTN), other wireless networks, and any other network topology that can be used to interconnect the information handling systems. Many of the information handling systems include nonvolatile data stores, such as hard drives and/or nonvolatile memory. Some of the information handling systems shown in FIG. 2 depicts separate nonvolatile data stores (server 260 utilizes nonvolatile data store 265, mainframe computer 270 utilizes nonvolatile data store 275, and information handling system 280 utilizes nonvolatile data store 285). The nonvolatile data store can be a component that is external to the various information handling systems or can be internal to one of the information handling systems. In addition, removable nonvolatile storage device 145 can be shared among two or more information handling systems using various techniques, such as connecting the removable nonvolatile storage device 145 to a USB port or other connector of the information handling systems.

FIGS. 3A-8 depict an approach that performs N-channel audio compression using a polar vector digitization mechanism. The approach provides an embodiment of proposed data formats, algorithms, flow of control, and proposed mathematics. The approach provides an algorithm that can take N sources arranged in any way around the target user, encode it to a channel independent format, and decode it to M output devices.

The core reasoning behind this algorithm is that N channels of audio arranged around a listener can be represented as a $\{A_0 \ldots A_{2\pi-\theta}\}$ array for each t, where A is amplitude, $\theta$ is the sampling angle, and t is the time sample. The interval of $\theta$ can be chosen to give as rich or as poor a sampling rate as desired. At the lower limit of $\theta=2\pi$, such a representation devolves to the monaural case of $\{A_0\}$, $\{A_1\}$, $\{A_2\}$, . . . $\{A_n\}$ for $t=\{0 \ldots n\}$. For higher dimensions of $\theta$, the sampling rate can be constructed as fits the fidelity needs of the source. For example, a 7.1 stream can be sampled without artifacts at $\theta=\pi/13$.

For efficiency in compression and calculation, in one embodiment, the values of $\theta$ are restricted to powers of 2. This restriction gains four advantages. First, this restriction provides the ability to incorporate variable sampling depths without allocating too much data on indicator bits. Second, this restriction provides the ability to use packed binary compression routines against the sample data. Third, this restriction provides for automatic alignment of the data stream. And fourth, this restriction provides speed efficiency in higher level compression transforms.

Sampling

A sampling methodology of the analog audio is utilized. In one embodiment, the sampling methodology utilizes receives N channels of digital audio input coming in from a digital or analog source. Each channel has an constant associated angle $\alpha_c$ from arbitrary reference zero angle. A bit depth for each sample is specified ahead of time, such as an 8 or 16 bit depth. In addition, A time based sampling rate is chosen ahead of time.

In one embodiment, such as for high-fidelity analog applications, the analog inputs are physically arranged along axes evenly distributed along the number of input channels. In another embodiment, arbitrary arrangements are utilized, such as for usual mid-fidelity sample bit depths of 8 or 16. The minimum angular division $\tau$ between two channels is computed by subtracting each ac from $\alpha c+1$ modulo $2\pi$. An angular sample size of $\theta=2\pi/(\tau*2)$ is chosen. Angle zero is chosen in such a way that no analog input lies on a boundary, and the distribution across all samples is such that every other sample has no inputs lying in it. In one embodiment, angle zero represents the approximate direction of the intended observer, or listener, of the audio. Each audio channel from $\{1 \ldots N\}$ is assigned to a sample channel in $\{0 \ldots 2\pi-\theta\}$. This creates a sparse incoming channel signal.

For each time t, a sample of the desired bit depth is taken from the input in each angle and the resulting channels connected together into a continuous waveform. Zero channels are dropped, and the dropped channels noted as a separate part of the sample. The samples are arranged in a variable length digital array for each time t.

In an embodiment using fewer than four channels, somewhat different handling may be utilized. In the case of two speakers that are not aligned opposite each other, or three speakers, it becomes inefficient to digitize on equal size channels. In this case, bytes that specify the angular offset of each channel can be added to the zero adjustment and marked in a compression header to aid in better decoding. Such header marking comprises one, two, or three 16 bit floating point values measured in radians.

Compression

Once an angular based array representation of the sample data is created, the results are compressed in several steps. First, a compression header is created. In one embodiment, the compression header has the following elements: (1) an eyecatcher that indicates the kind of compression used; (2) a version element; (3) a file size; (4) an entry indicating the number of angular channel samples; (5) an entry indicating the bit depth of each channel sample; (6) an entry indicating the time division sampling rate; and (7) an optional entry for angular displacement and low channel special case (i.e., fewer than four channels).

Compression starts with an array of $2\pi/\theta$ samples, such as $\{S_0, S_1, S_2 \ldots S_{2\pi-\theta}\}$. The approach reduces the sample array by dropping out (removing) zero values. Every other sample will be empty due to zero position adjustment, so the channels that contain data are noted in a bitfield B of the size $\pi/\theta$. The channel samples are normalized against itself by subtracting out a quantized mode value. The normalization constant M is stored.

In the approach utilizing this embodiment, the sample at time t now appears as $\{B, M, S_0\text{-}M, S_1\text{-}M \ldots S_{2\pi-\theta}\text{-}M\}$. At this point, using typical audio data, the majority of samples will now be zero. The approach uses this characteristic to make a determination based on the number of zeroes. If a typical sample is detected, the approach runs a run-length encoding (RLE) compression to reduce the sparse matrix to a smaller not sparse matrix. The RLE data is smaller than sample data (2-6 bits vs 8 or 16) so the approach can combine it with a known property bitfield to indicate that the data is RLE data. For example, the approach might define a bitfield of 16 bits with 1 s on each end that is impossible in the sample data to represent RLE data.

In the approach, the sample at time t now looks like $\{B, M, S_0\text{-}M|Z_0, \ldots S_{2\pi-\theta}\text{-}M|Z_x\}$. The approach no longer has any zero samples in it and is fully useful data. At this point, the approach measures the compression of the sample against a desired goal. If compression is sufficient, the sample is stored and processing and moves to the next time mark. At the end of the sample, the approach adds a unique eyecatcher, such as an eyecatcher of eight zero bits, indicating that sample is stored. If additional compression is required, the approach runs a bitwise Fourier transform on the sample array. This will produce a new set of samples with a large number of contiguous bits. A bitwise RLE or token compression can be done to reduce the payload size further. Lossy compression can be done at this stage to ever further reduce the data payload.

In one embodiment, the final compressed sample appears as $\{B, M, F_0, F_1, \ldots F_j\}$ where $j<<2\pi/\theta$. This is stored along with an end eyecatcher indicating how the sample was further compressed. Sample are strung together along with time marks to compose the compressed audio bitstream. This bit stream can be saved or transmitted for later decompression.

Decompression

In one embodiment, decompression begins by receiving a compression header. The version included in the header is used to determine which algorithms are supported. The bit depth and time clocking found in the header are used to determine the size of receiver buffers and loops to use in decompression. Once initialized, the decompression proceeds on a time sample by time sample basis. For each time sample: (1) the eyecatcher is read and optional standard compression steps undone; (2) any Fourier transform (FFT) data is reversed; (3) RLE is used to expand the sample bits and zeroes into their respective bytes; (4) the quantization value is added back into the data; (5) zero channels are added back into the data; and (6) angular offsets, if present, are added back in to the data.

Figure 3A:
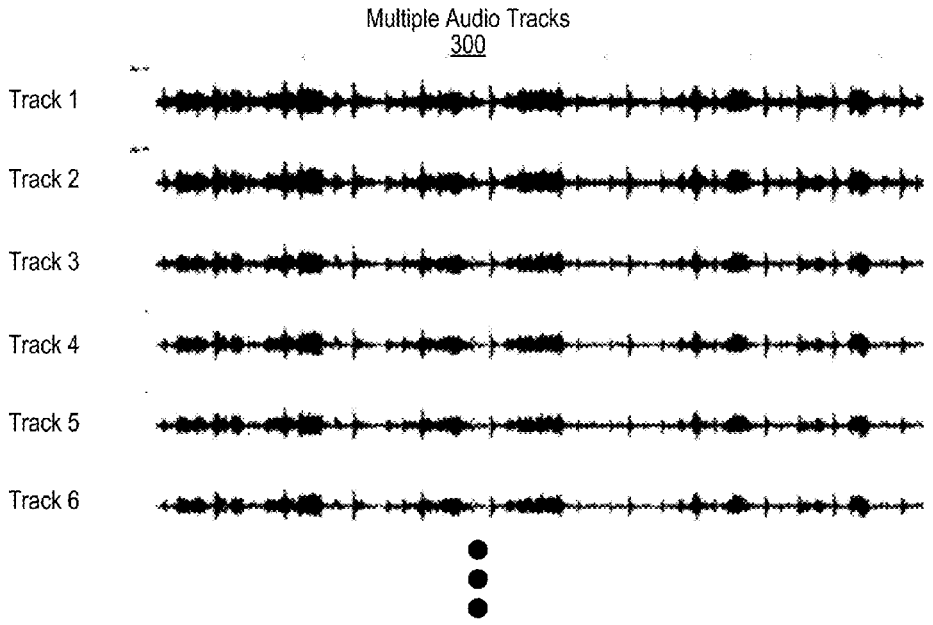
FIG. 3A is a diagram of multiple audio track signatures.

FIG. 3A is a diagram of multiple audio track signatures. Graphs 300 depict a number of different audio tracks are shown (tracks 1-6, etc.) with each track being a signature of the input received at a different microphone during the same time interval. For example, track 1 might be a microphone directly in front of (angle zero) an analog sound source, and the other tracks represent inputs received at other microphones at various angles around the analog sound source.

Figure 3B:
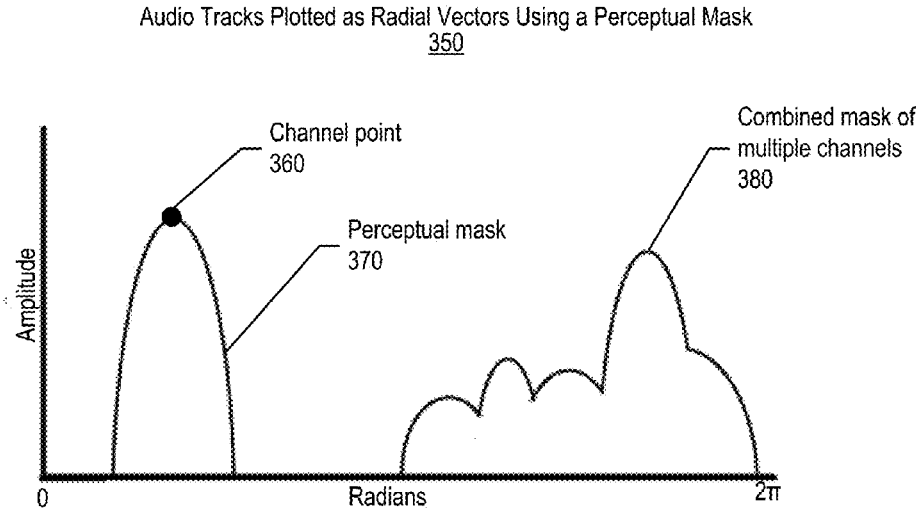
FIG. 3B is a diagram of multiple audio tracks plotted as radial vectors using a perceptual mask.

FIG. 3B is a diagram of multiple audio tracks plotted as radial vectors using a perceptual mask. Graph 350 is depicted with the y-axis being the amplitude and the x-axis being the angle in radians (from zero to $2\pi$). Graph 350 depicts perceptual mask 370 as a curve with channel point 360 being the high amplitude point in the perceptual mask. Combined mask 380 is shown as a curve representing the combination of multiple channels, such as the multiple channels shown in FIG. 3A.

Figure 4A:
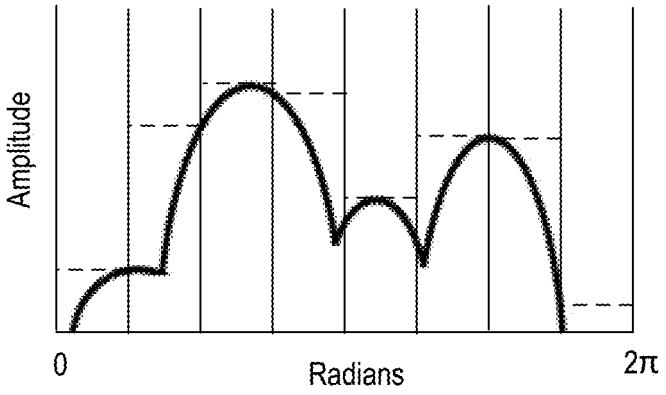
FIG. 4A is a sampling diagram each angular interval using a consistent algorithm depending on the perceptual mask.

FIG. 4A is a sampling diagram each angular interval using a consistent algorithm depending on the perceptual mask. Graph 400 is depicted with the y-axis being the amplitude and the x-axis being the angle in radians (from zero to $2\pi$). Graph 400 depicts the result from sampling of each angular interval using a consistent algorithm depending on the perceptual mask and the combining of the masks. In the example shown, eight angular intervals are sampled with the range zero to $2\pi$ radians being divided into eight equal angular intervals. The horizontal dashed lines shown on graph 400 represent the sample taken at each of the angular intervals.

Figure 4B:
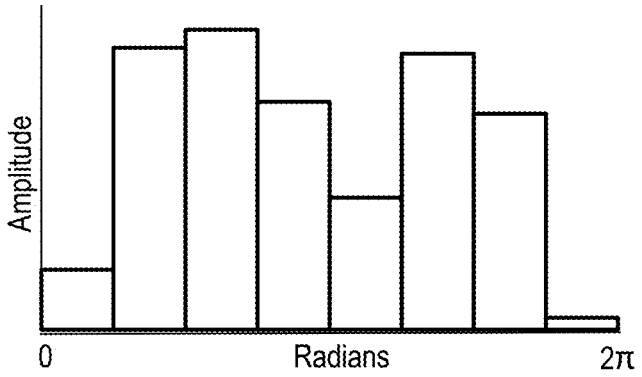
FIG. 4B is a diagram showing quantized waveforms produced across all channels by the sampling.

FIG. 4B is a diagram showing quantized waveforms produced across all channels by the sampling. Graph 450 is depicted with the y-axis being the amplitude and the x-axis being the angle in radians (from zero to $2\pi$). In graph 450, the graphed data represents the digital sample of each of the angular intervals. In the example shown, eight angular intervals are sampled with the range zero to $2\pi$ radians being divided into eight equal angular intervals. Each column represents the value of the angular intervals based on the sample taken of the respective intervals.

Figure 5:
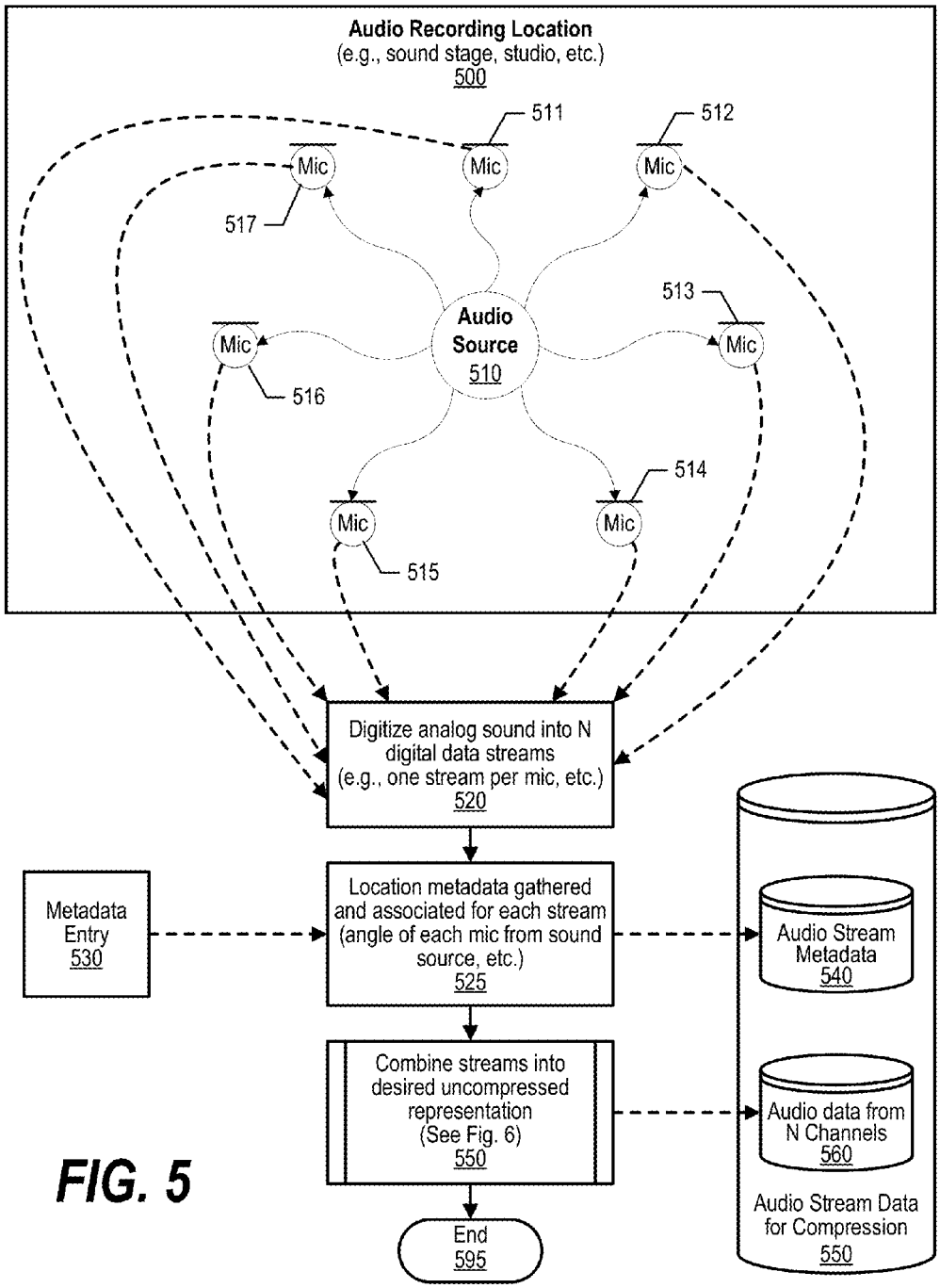
FIG. 5 is flowchart showing steps used to create audio data and metadata using inputs from an audio source.

FIG. 5 is flowchart showing steps used to create audio data and metadata using inputs from an audio source. Audio recording location 500 might be a sound stage, a recording studio, a theatre, or any place where recording of an audio source is desired. Audio source 510, such as a singer, performer, or instrument, produces analog sound that is captured by microphones 511 through 517. Any number of microphones can be utilized and arranged at various angular intervals around audio source 510.

Processing commences at step 520, where the process digitizes analog sound into N digital data streams (e.g., one stream per microphone, etc.). In the example shown, the sound would be digitized into seven data streams as seven microphones are depicted in audio recording location 500. However, any number of audio input devices can be utilized.

At step 525, the process gathers location metadata and this metadata is associated for each stream (angle of each microphone from sound source, etc.). For example, if the intended observer of the audio is represented by microphone 511, the location metadata of the stream corresponding to microphone 511 might be angle zero with the other microphones being at their respective angle intervals from microphone 511. In one embodiment, the location metadata is input through metadata entry 530 which may be a manual or automated process depending on the sophistication of audio recording location 500. The audio stream metadata is stored in data store 540.

Figure 6:
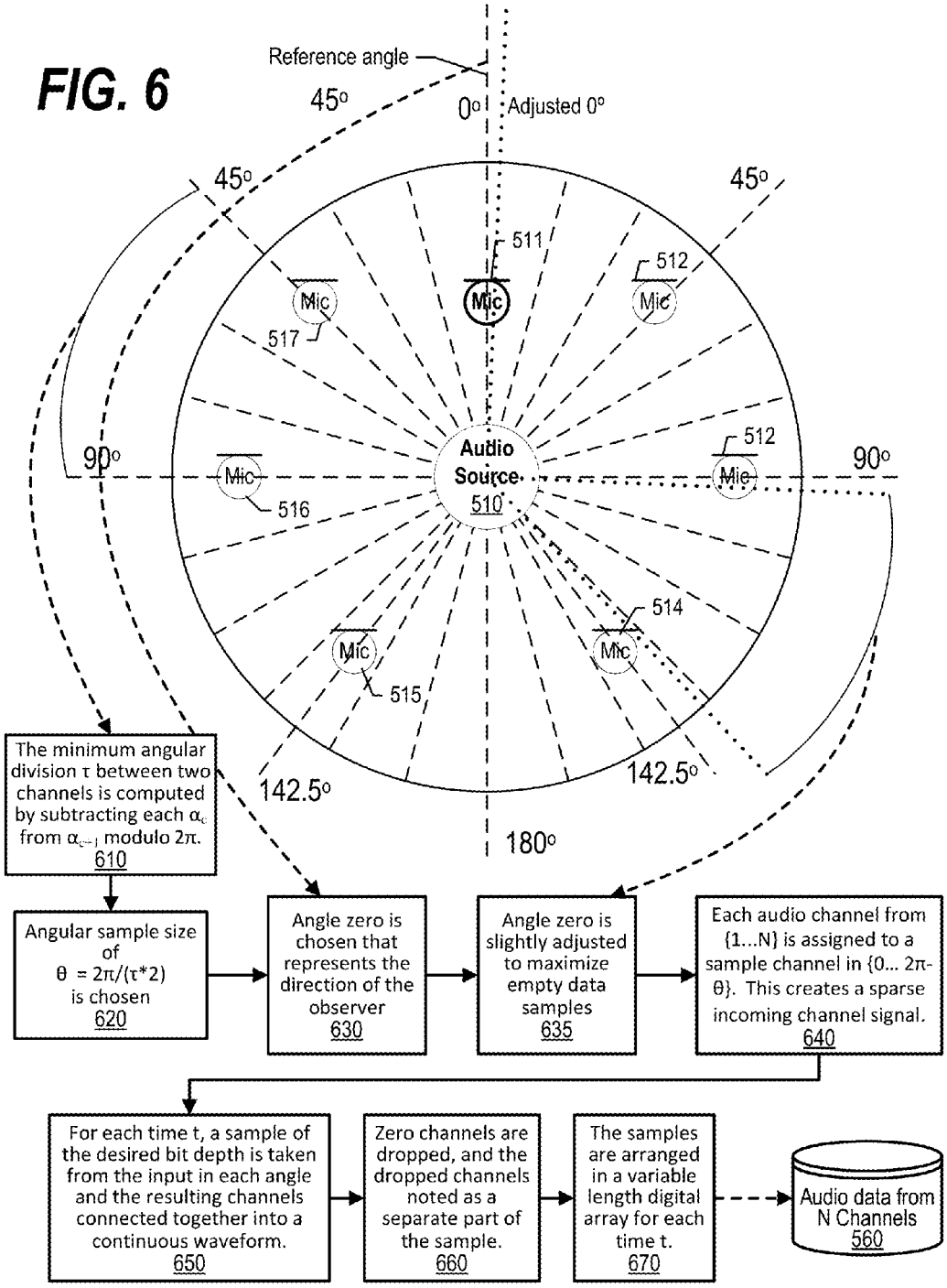
FIG. 6 is a flowchart showing steps taken to capture the audio data given the angular displacement of microphones from the audio source.

At predefined process 550, the process performs the Combine Streams routine that combines the streams into a desired uncompressed representation (see FIG. 6 and corresponding text for processing details). The combined audio data for N channels is stored in data store 560.

Figure 7:
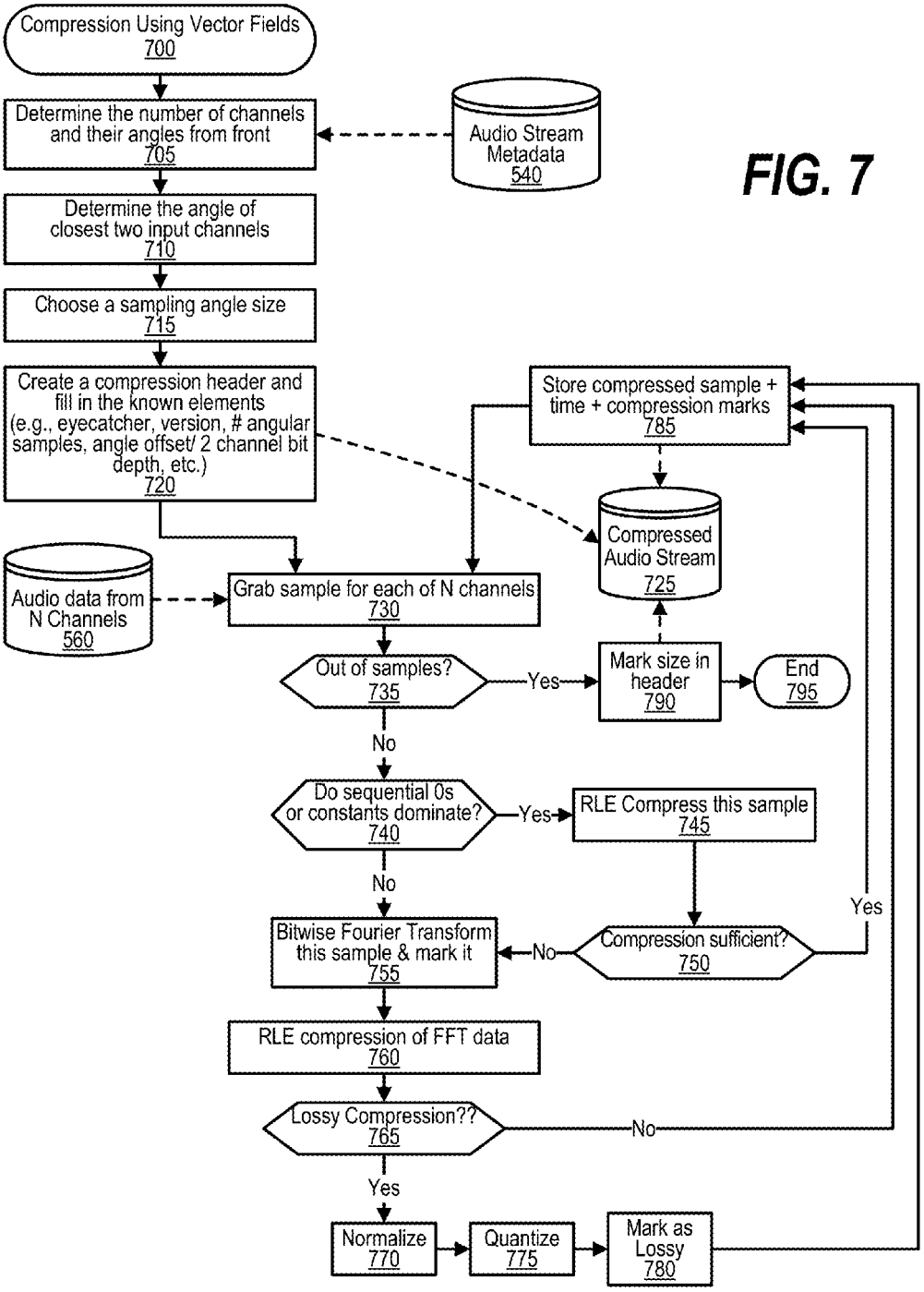
FIG. 7 is a flowchart showing steps taken by a process that compresses the audio data using vector fields.

Data store 550 represents the audio stream data that is needed to perform compression as shown in FIG. 7. This data includes the audio stream metadata (data store 540) as well as the actual audio data captured from the N channels of audio input (data store 560). FIG. 5 processing thereafter ends at 595.

FIG. 6 is a flowchart showing steps taken to capture the audio data given the angular displacement of microphones from the audio source. In the example shown, microphone 511 is in the intended direction from audio source 510. Consequently, in one embodiment, microphone 511 is assigned to be angle zero from the source. The remaining microphones are then assigned at their respective angular intervals from microphone 511. In the example shown, microphone 512 is approximately 45 degrees from microphone 511, microphone 513 is approximately 90 degrees from microphone 511, and so on.

Processing commences whereupon, at step 610, the process computes the minimum angular division T between two channels by subtracting each $\alpha_c$ from $\alpha_{c+1}$ modulo $2\pi$. At step 620, the process selects an angular sample size of $\theta=2\pi/(\tau*2)$. At step 630, the process selects an input as angle zero with this input representing the direction of the intended observer of the audio. At step 635, the zero angle is adjusted so that no channel lies exactly on a sample border and so that a maximum number of empty samples are attained. At step 640, the process assigns each audio channel from $\{1 \ldots N\}$ to a sample channel in the range of $\{0 \ldots 2\pi-\theta\}$ radians. This creates a sparse incoming channel signal. At step 650, for each time t, the process takes a sample of the desired bit depth from the input in each of the angles and the resulting channels are connected together into a continuous waveform. At step 660, the process drops, or removes, channels with values of zero, and the dropped channels are noted as a separate part of the sample. At step 670, the process arranges the samples in a variable length digital array for each time t. The audio data from N channels are stored in data store 560.

FIG. 7 is a flowchart showing steps taken by a process that compresses the audio data using vector fields. FIG. 7 commences at 700 and shows the steps taken by a process that performs compression using vector fields. At step 705, the process determines the number of channels and their angles from a reference, or zero, angle. The number of channels and their angular placement from each other is retrieved from audio stream metadata (data store 540). In one embodiment, the zero angle represents the direction of the intended observer.

At step 710, the process determines the angle of the closest two input channels. At step 715, the process chooses a sampling angle size. At step 720, the process creates a compression header and fills in the known elements (e.g., eyecatcher, version, number of angular samples, angle offsets, channel bit depth, etc.). At step 730, the process grabs a first sample from each of the N channels. A loop is established with the process processing samples until no more samples remain (decision 735). Until the routine runs out of samples, decision 735 continues to branch to the 'no' branch to process the last sample grabbed. The looping continues until there are no more samples, at which point decision 735 branches to the 'yes' branch to conclude compression processing.

Steps 740 through 785 are processed for the sample grabbed at step 730. The process determines as to whether sequential zeros or constants dominate the sample that was grabbed (decision 740). If sequential zeros or constants dominate the sample that was grabbed, then decision 740 branches to the 'yes' branch whereupon, at step 745, run-length encoding (RLE) is performed on the sample. A determination is made as to whether the RLE compression of the sample was sufficient to satisfy compression thresholds (decision 750). If the RLE compression was not sufficient, then decision 750 branches to the 'no' branch for further compression steps. On the other hand, if the RLE compression was sufficient, then decision 750 branches to the 'yes' branch bypassing further compression found in steps 755 through 780.

Returning to decision 740, if sequential zeros or constants do not dominate the sample that was grabbed, then decision 740 branches to the 'no' branch bypassing the RLE compression found in steps 745 and 750. At step 755, the process performs a Fourier transform of the sample and the sample is accordingly marked as having been Fourier transformed. At step 760, the process performs an RLE compression of the Fourier transformed (FFT) data. The process determines as to whether to perform lossy compression on the sample (decision 765). The decision might be made based on a compression threshold so that lossy compression is performed if further compression of the sample is desired in view of the threshold.

If lossy compression is being performed on the sample, then decision 765 branches to the 'yes' branch to perform steps 770 through 780. On the other hand, if lossy compression is not being performed on the sample, then decision 765 branches to the 'no' branch bypassing steps 770 through 780. During lossy compression, at step 770, the process normalizes the sample. Then, at step 775, the process quantizes the sample. Finally, at step 780, the process marks the sample as having been lossy compressed. At step 785, after the sample has been compressed using steps 740 through 780, the process stores the compressed sample, the time corresponding to the sample, and any compression marks pertaining to the sample into compressed audio stream 725. Returning to decision 735, when the routine runs out of samples to process, then decision 735 branches to the 'yes' branch whereupon, at step 790, the size of the compressed audio stream is marked in the header area of the audio stream. Compression of the audio data using vector fields thereafter ends at 795.

Figure 8:
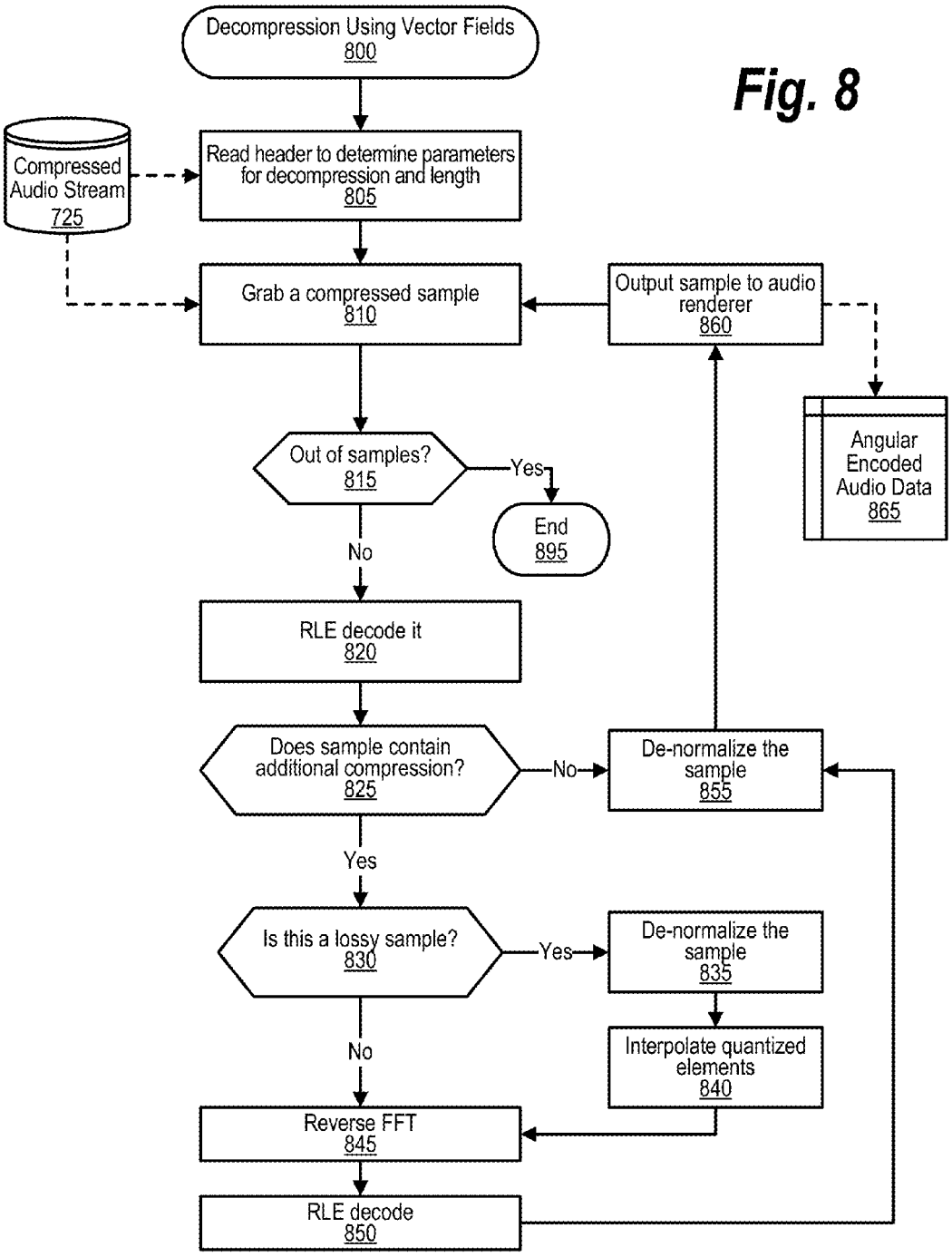
FIG. 8 is a flowchart showing steps taken by a process that decompresses the audio data using vector fields.

FIG. 8 is a flowchart showing steps taken by a process that decompresses the audio data using vector fields. FIG. 8 commences at 800 and shows the steps taken by a process that performs decompression of a compressed audio by utilizing vector fields. At step 805, the process reads the header from compressed audio stream (data store 725) to determine the parameters to use for decompression and the length of the compressed audio file. In one embodiment, the compressed audio stream was generated using the compression processing shown in FIG. 7.

At step 810, the process grabs a compressed sample from data store 725. A loop is established to process samples until there are no more samples to process (decision 815). While samples remain to be processed, decision 815 continues to branch to the 'no' branch to decompress and output the sample. This looping continues until there are no more samples to process, at which point decision 815 branches to the 'yes' branch whereupon decompression processing ends at 895.

At step 820, the process decodes the selected sample using run-length encoding (RLE) if any RLE encoding was found in the sample. The process determines as to whether does the sample contains additional compression (decision 825). If the sample contains additional compression, then decision 825 branches to the 'yes' branch to further decompress using steps 830 through 850. On the other hand, if the sample does not contain additional compression, then decision 825 branches to the 'no' branch bypassing steps 830 through 850. The process determines as to whether the sample was compressed using lossy compression (decision 830). If the sample was compressed using lossy compression, then decision 830 branches to the 'yes' branch whereupon, at step 835, the sample is de-normalized and, at step 840, the process interpolates quantized elements pertaining to the sample. On the other hand, if the sample was not compressed using lossy compression, then decision 830 branches to the 'no' branch bypassing steps 835 and 840.

At step 845, the process performs a reverse Fourier transform (FFT) on the sample. At step 850, the process decodes the sample using RLE decoding. After the sample has been decompressed using steps 820 through 850, then at step 855, the process de-normalizes the sample. The decompressed and de-normalized sample is then output to an audio renderer at step 860 with the audio renderer receiving angular encoded audio data which is stored in memory area 865.

While particular embodiments have been shown and described, it will be obvious to those skilled in the art that, based upon the teachings herein, that changes and modifications may be made without departing from this disclosure and its broader aspects. Therefore, the appended claims are to encompass within their scope all such changes and modifications as are within the true spirit and scope of this disclosure. Furthermore, it is to be understood that the invention is solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to others containing only one such element, even when the same claim includes the introductory phrases "one or more" or "at least one" and indefinite articles such as "a" or "an"; the same holds true for the use in the claims of definite articles.

What is claimed is:

1. A method comprising:

retrieving a plurality of digital sound data streams from one or more memories;

retrieving an orientation angle corresponding to each of the digital sound data streams from the one or more memories; and generating a digital representation of an analog sound by processing the plurality of digital sound data streams and the orientation angles, wherein the generating further comprises computing a minimum angular division between two of the plurality of digital sound data streams.

2. The method of claim 1 wherein the generating further comprises:

selecting an angular sample size based on the minimum angular division;

assigning a first of the digital sound data streams as angle zero; and assigning each of the digital sound data streams to an angular based sample channel.

3. The method of claim 2 wherein the first digital sound data stream is selected based on the first digital sound data stream being the closest of the plurality of the digital sound data streams to a direction of an intended observer of the analog sound, and wherein the method further comprises:

over a plurality of time offsets, repeatedly combining a plurality of samples from each of the digital sound data streams, wherein the combined samples are from a same time offset from the plurality of time offsets.

4. The method of claim 2 further comprising:

increasing an amount of generated null data by offsetting the angle of the first digital sound data stream.

5. The method of claim 2 further comprising:

sampling an analog data stream corresponding to each of the digital sound data streams at each of a plurality of time offsets to generate a plurality of samples to use in each of the digital sound data streams, wherein the sampling further comprises:

identifying a desired bit depth;

taking the samples of the desired bit depth from each of the plurality of angular based sample channels; and connecting the taken samples together in a continuous waveform.

6. The method of claim 5 further comprising:

outputting the taken samples into a variable length digital array for each of the plurality of time offsets.

7. The method of claim 1 further comprising:

compressing the digital representation, wherein the compressing further comprises:

retrieving a sample from each of the digital sound data streams included in the digital representation, wherein the samples retrieved are from a same time offset, the retrieved samples being a sample set;

modifying the sample set by performing a run-length encoding (RLE) compression on the sample set in response to identifying a dominance of sequential data in the sample set;

modifying the sample set by performing a bitwise Fourier transform on the sample set;

modifying the sample set by performing a lossy compression on the sample set;

storing, into a compressed audio stream, the sample set after performing the modifications; and repeating the retrieving step, modifying steps, and storing step over the plurality of time offsets.

8. The method of claim 7 further comprising:

normalizing the sample set;

generating a compression header, wherein the compression header includes a number of the plurality of angular based sample channels and the minimum angular division; and storing the compression header in the compressed audio stream.

9. The method of claim 1 further comprising:
identifying one or more zero channels from the plurality of digital sound data streams, wherein the zero channels are void of digital sound data; and
inhibiting inclusion of the identified zero channels in the digital representation.

10. An information handling system comprising:
one or more processors;
a memory coupled to at least one of the processors; and
a set of instructions stored in the memory and executed by at least one of the processors to:
retrieve a plurality of digital sound data streams from the memory;
retrieve an orientation angle corresponding to each of the digital sound data streams from the memory; and
generate a digital representation of an analog sound based on the plurality of digital sound data streams and the orientation angles, wherein the generation of the digital representation further comprises computing a minimum angular division between two of the plurality of digital sound data streams.

11. The information handling system of claim 10 wherein the generation of the digital representation further comprises:
selecting an angular sample size based on the minimum angular division;
assigning a first of the digital sound data streams as angle zero; and
assigning each of the digital sound data streams to an angular based sample channel.

12. The information handling system of claim 11 wherein the first digital sound data stream is selected based on the first digital sound data stream being the closest of the plurality of the digital sound data streams to a direction of an intended observer of the analog sound, and wherein the set of instructions further comprise further instructions executed by at least one of the processors to:
over a plurality of time offsets, repeatedly combine a plurality of samples from each of the digital sound data streams, wherein the combined samples are from a same time offset from the plurality of time offsets.

13. The information handling system of claim 11 wherein the set of instructions further comprise further instructions executed by at least one of the processors to:
increase an amount of generated null data by offsetting the angle of the first digital sound data stream.

14. The information handling system of claim 11 wherein the set of instructions further comprise further instructions executed by at least one of the processors to:
sample an analog data stream corresponding to each of the digital sound data streams at each of a plurality of time offsets to generate a plurality of samples to use in each of the digital sound data streams, wherein the sampling further comprises:
identify a desired bit depth;
take the samples of the desired bit depth from each of the plurality of angular based sample channels; and
connect the taken samples together in a continuous waveform.

15. The information handling system of claim 14 wherein the set of instructions further comprise further instructions executed by at least one of the processors to:
output the taken samples into a variable length digital array for each of the plurality of time offsets.

16. The information handling system of claim 10 wherein the set of instructions further comprise further instructions executed by at least one of the processors to:
compress the digital representation, wherein the compression of the digital representation further comprises:
retrieve a sample from each of the digital sound data streams included in the digital representation, wherein the samples retrieved are from a same time offset, the retrieved samples being a sample set;
modify the sample set by performing a run-length encoding (RLE) compression on the sample set in response to identifying a dominance of sequential data in the sample set;
modify the sample set by performing a bitwise Fourier transform on the sample set;
modify the sample set by performing a lossy compression on the sample set;
store, into a compressed audio stream, the sample set after performing the modifications; and
repeat the retrieval step, the modification steps, and the storage step over the plurality of time offsets.

17. The information handling system of claim 16 wherein the set of instructions further comprise further instructions executed by at least one of the processors to:
normalize the sample set;
generate a compression header, wherein the compression header includes a number of the plurality of angular based sample channels and the minimum angular division; and
store the compression header in the compressed audio stream.

18. The information handling system of claim 10 wherein the set of instructions further comprise further instructions executed by at least one of the processors to:
identify one or more zero channels from the plurality of digital sound data streams, wherein the zero channels are void of digital sound data; and
inhibit inclusion of the identified zero channels in the digital representation.

19. A computer program product comprising:
a computer readable storage medium comprising a set of computer instructions, the computer instructions effective to:
retrieve a plurality of digital sound data streams from one or more memories;
retrieve an orientation angle corresponding to each of the digital sound data streams from one of the memories; and
generate a digital representation of an analog sound based on the plurality of digital sound data streams and the orientation angles, wherein the generation of the digital representation further comprises computing a minimum angular division between two of the plurality of digital sound data streams.

20. The computer program product of claim 19 wherein the generation of the digital representation further comprises:
selecting an angular sample size based on the minimum angular division;
assigning a first of the digital sound data streams as angle zero; and
assigning each of the digital sound data streams to an angular based sample channel.

21. The computer program product of claim 20 wherein the first digital sound data stream is selected based on the first digital sound data stream being the closest of the plurality of the digital sound data streams to a direction of an intended observer of the analog sound, and wherein the set of instructions further comprise instructions effective to:

over a plurality of time offsets, repeatedly combine a plurality of samples from each of the digital sound data streams, wherein the combined samples are from a same time offset from the plurality of time offsets.

22. The computer program product of claim 20 wherein the set of instructions further comprise instructions effective to:

increase an amount of generated null data by offsetting the angle of the first digital sound data stream.

23. The computer program product of claim 20 wherein the set of instructions further comprise instructions effective to:

sample an analog data stream corresponding to each of the digital sound data streams at each of a plurality of time offsets to generate a plurality of samples to use in each of the digital sound data streams, wherein the sampling further comprises:

identify a desired bit depth;

take the samples of the desired bit depth from each of the plurality of angular based sample channels; and connect the taken samples together in a continuous waveform.

24. The computer program product of claim 19 wherein the set of instructions further comprise instructions effective to:

output the taken samples into a variable length digital array for each of the plurality of time offsets.

25. The computer program product of claim 19 wherein the set of instructions further comprise instructions effective to:

compress the digital representation, wherein the compression of the digital representation further comprises:

retrieve a sample from each of the digital sound data streams included in the digital representation, wherein the samples retrieved are from a same time offset, the retrieved samples being a sample set;

modify the sample set by performing a run-length encoding (RLE) compression on the sample set in response to identifying a dominance of sequential data in the sample set;

modify the sample set by performing a bitwise Fourier transform on the sample set;

modify the sample set by performing a lossy compression on the sample set;

store, into a compressed audio stream, the sample set after performing the modifications; and repeat the retrieval step, the modification steps, and the storage step over the plurality of time offsets.

26. The computer program product of claim 19 wherein the set of instructions further comprise instructions effective to:

normalize the sample set;

generate a compression header, wherein the compression header includes a number of the plurality of angular based sample channels and the minimum angular division; and store the compression header in the compressed audio stream.

27. The computer program product of claim 19 wherein the set of instructions further comprise instructions effective to:

identify one or more zero channels from the plurality of digital sound data streams, wherein the zero channels are void of digital sound data; and inhibit inclusion of the identified zero channels in the digital representation.

28. An apparatus comprising:

one or more processors that perform retrieval logic on a plurality of digital sound data streams;

retrieval logic performed by at least one of the processors that retrieves an orientation angle corresponding to each of the digital sound data streams; and generation logic performed by at least one of the processors that generates a digital representation of an analog sound based on the plurality of digital sound data streams and the respective orientation angles of the digital sound data streams wherein the generation logic further comprises:

computational logic performed by at least one of the processors that computes a minimum angular division between two of the plurality of digital sound data streams;

selection logic performed by at least one of the processors that selects an angular sample size based on the minimum angular division;

assignment logic performed by at least one of the processors that assigns a first of the digital sound data streams as angle zero; and assignment logic performed by at least one of the processors that assigns each of the digital sound data streams to an angular based sample channel.

* * * * *